US010209029B2

(12) United States Patent
Horak

(10) Patent No.: US 10,209,029 B2
(45) Date of Patent: Feb. 19, 2019

(54) HIGH PERFORMANCE MUZZLE LOADING BREECH PLUG

(71) Applicant: Luke William Horak, Cedar Rapids, IA (US)

(72) Inventor: Luke William Horak, Cedar Rapids, IA (US)

( * ) Notice: Subject to any disclaimer, the term of this patent is extended or adjusted under 35 U.S.C. 154(b) by 0 days.

(21) Appl. No.: 15/915,786

(22) Filed: Mar. 8, 2018

(65) Prior Publication Data

US 2018/0259291 A1 Sep. 13, 2018

Related U.S. Application Data

(60) Provisional application No. 62/470,858, filed on Mar. 13, 2017.

(51) Int. Cl.
*F41C 7/00* (2006.01)
*F41C 9/08* (2006.01)

(52) U.S. Cl.
CPC ..... *F41C 9/085* (2013.01)

(58) Field of Classification Search
CPC ..... F41C 9/08; F41C 9/085
See application file for complete search history.

(56) References Cited

U.S. PATENT DOCUMENTS 4,222,191 A * 9/1980 Lee ..... F41A 21/12 42/51
5,005,485 A * 4/1991 Woo ..... B25B 27/0085 102/469
5,408,776 A * 4/1995 Mahn ..... F41C 9/08 42/51
5,511,334 A * 4/1996 Ball ..... F41C 9/08 42/51
5,706,598 A * 1/1998 Johnston ..... F41C 9/08 42/51
6,176,030 B1 * 1/2001 Ball ..... F41C 9/08 42/51
6,216,380 B1 * 4/2001 McGarity, Jr. ..... F41C 9/08 42/51
7,526,888 B1 * 5/2009 Joyce ..... F41A 3/64 42/51
2006/0026881 A1 * 2/2006 Watley ..... F41C 9/08 42/51

OTHER PUBLICATIONS

Applicant Admitted Prior Art Breech Plug System.

* cited by examiner

*Primary Examiner* — Gabriel J. Klein
(74) *Attorney, Agent, or Firm* — Simmons Perrine Moyer Bergman PLC

(57) ABSTRACT

A muzzle loading breech plug system designed for high performance muzzle loading rifles, including, but not limited to, bolt actions and break actions. The system is comprised of the following: 1) A breech plug body threaded to fit corresponding threads on the muzzle loading firearm. 2) A bushing designed to prevent powder from passing completely through the barrel, but still allowing flame from primer to ignite powder while being resistant to gas wear. 3) A retention module/adapter insert that holds bushing in place while mating with primer holder module. 4) Primer holder module designed to hold a large rifle magnum primer and mate up with the other components of the system providing reliable sealing and consistent ignition.

20 Claims, 10 Drawing Sheets

HIGH PERFORMANCE MUZZLE LOADING BREECH PLUG

CROSS REFERENCE TO RELATED APPLICATIONS

This application claims the benefit of a provisional application filed on Mar. 13, 2017, and having Ser. No. 62/470,858 entitled "A NOVEL SELF-CLEANING BREECH PLUG SYSTEM FOR HIGH PERFORMANCE MUZZLE LOADING RIFLES" which is hereby incorporated herein in its entirety by this reference.

FIELD OF THE INVENTION

The present invention generally relates to muzzleloader rifles, and more particularly relates to high performance muzzleloader rifles, and, even more particularly, relates to high performance muzzleloader breech plug systems.

BACKGROUND OF THE INVENTION

The field of high performance muzzle loading has seen growth in popularity over the past decade. Numerous different variations of breech plugs and primer holder modules are in common use.

Over the last decade, the field has seen many new innovations. Some of these improvements include providing a short distance between primer and powder, providing a reliable seal, and improved durability. However, there are still short falls in performance, durability, and reliability that innovators in the field are seeking to overcome.

Some of the major improvements have been rear sealing plugs, brass primer module holders, vent liners, wear bushings, etc. While some of these systems work well, they all have shortcomings. Some of the short comings are as follows: challenging to manufacture, require frequent cleaning to maintain performance, unreliable, wear out quickly, unable to handle the higher pressures of magnum loads.

Consequently, there exists a need for improved methods and systems for plugging a breech portion of a high performance muzzleloader rifle.

SUMMARY OF THE INVENTION

It is an object of one aspect of the present invention to provide a muzzleloader rifle with an easy or self cleaning ability.

It is a feature of one aspect of the present invention to utilize a primer module which mates with an inside surface of a retention screw.

It is an advantage of the present invention to provide for a capability of easily cleaning residue after firing a shot.

It is an additional feature of the present invention to provide a bushing with rear installation.

It is an additional advantage of this embodiment of the present invention to provide for:

the possibility of removal of the bushing without the removal of the breech plug from the muzzleloader rifle;

a reducing in the amount of internal threading needed in the breech plug body; and increased ease of manufacture.

Accordingly, the present invention is:

A method for replacing a bushing, which is internal to a breech plug body which has a portion thereof disposed in a breech of a muzzleloader rifle comprising the steps of:

providing a muzzleloader rifle with a barrel having a muzzle and an opposing breech;

providing a breech plug body; having a muzzle end and a breech end, with a void therebetween, which void has a breech end opening which is open toward said breech end, wherein said void and said breech end opening are configured for receiving, therein and therethrough, respectively, a bushing;

disposing said bushing through said breech end opening into said void;

disposing said muzzle end of said breech plug body in a breech of a muzzleloader rifle, where the muzzle end is first to enter said barrel and said breech; so that said muzzle end is closer to said muzzle than said breech end is to said muzzle; and while said muzzle end of said breech plug body remains disposed in said barrel, removing said bushing from said void and through said breech end opening.

Additionally, the present invention is a system for operatively coupling a firing pin in a gun to powder in a barrel of a muzzleloader rifle, the system comprising:

a body, having a body muzzle end and opposing body configured to be retained inside a barrel of a muzzleloader rifle;

a bushing, configured to simultaneously restrict powder from exiting through a non-muzzle opening of said barrel while permitting ignition of said powder inside the barrel from an ignition source, said bushing being disposed inside said body;

a retention member, at least partially disposed inside said body, and configured to retain said bushing at a location inside said body;

a primer holder, having a primer holder muzzle end which is configured to be received inside said body and inside said retention member; and said body and said retention member configured to permit removal of said bushing from said body while said body is retained inside the barrel of the muzzleloader rifle.

DETAILED DESCRIPTION

Figure 1:
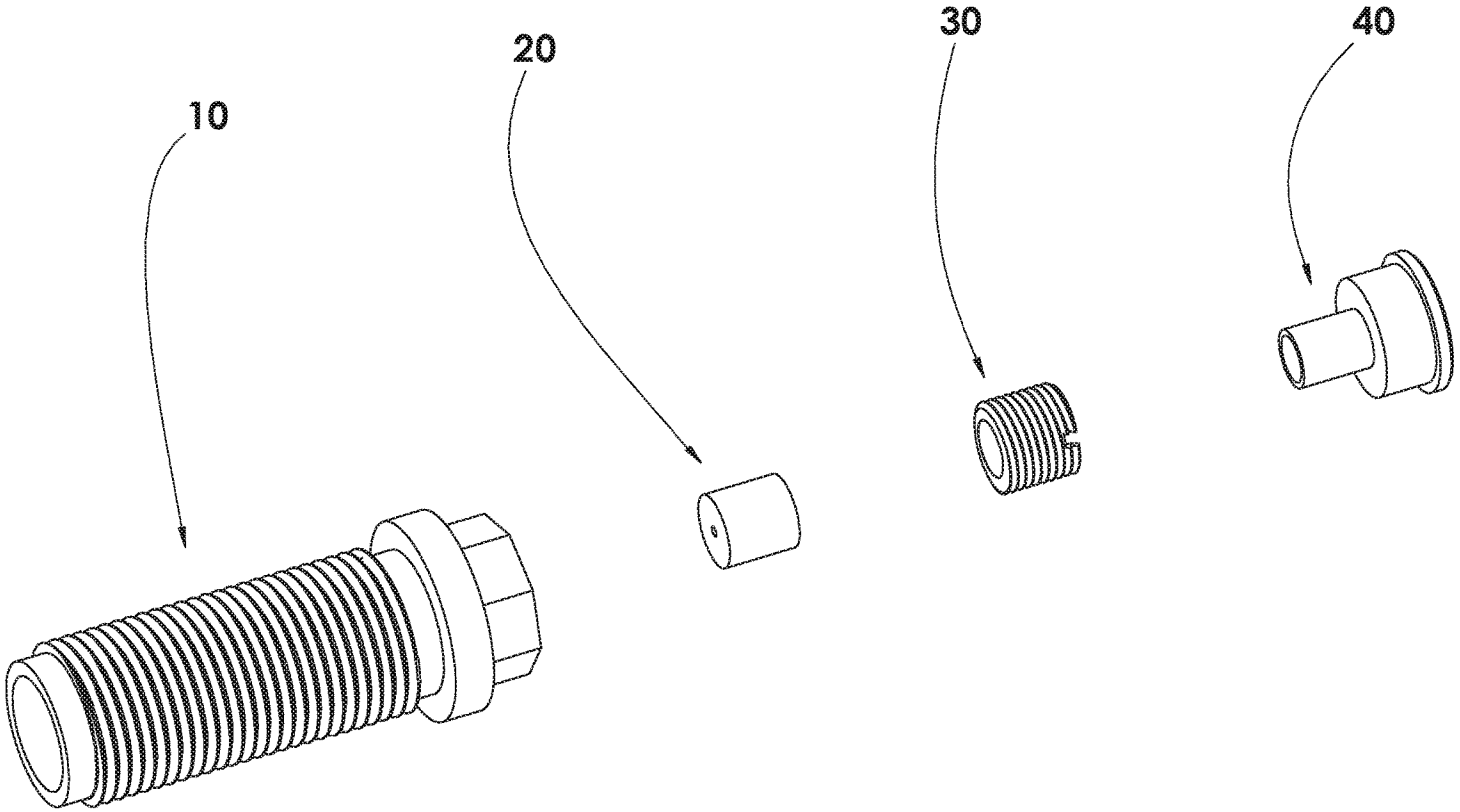
FIG. 1 is an exploded view of the present invention.

Now referring to the drawings wherein like numerals refer to like matter throughout and more particularly referring to FIG. 1, which is an exploded representation of an embodiment of the present invention. The general concepts of the structure and operation of muzzleloader breech plugs and muzzleloader rifle barrels are known to those skilled in the art. There is shown a breech plug body 10, bushing 20, retention module 30 and primer module holder 40, all of which are configured to be disposed in and/or at the breech of the barrel of a muzzleloader rifle.

Figure 2:
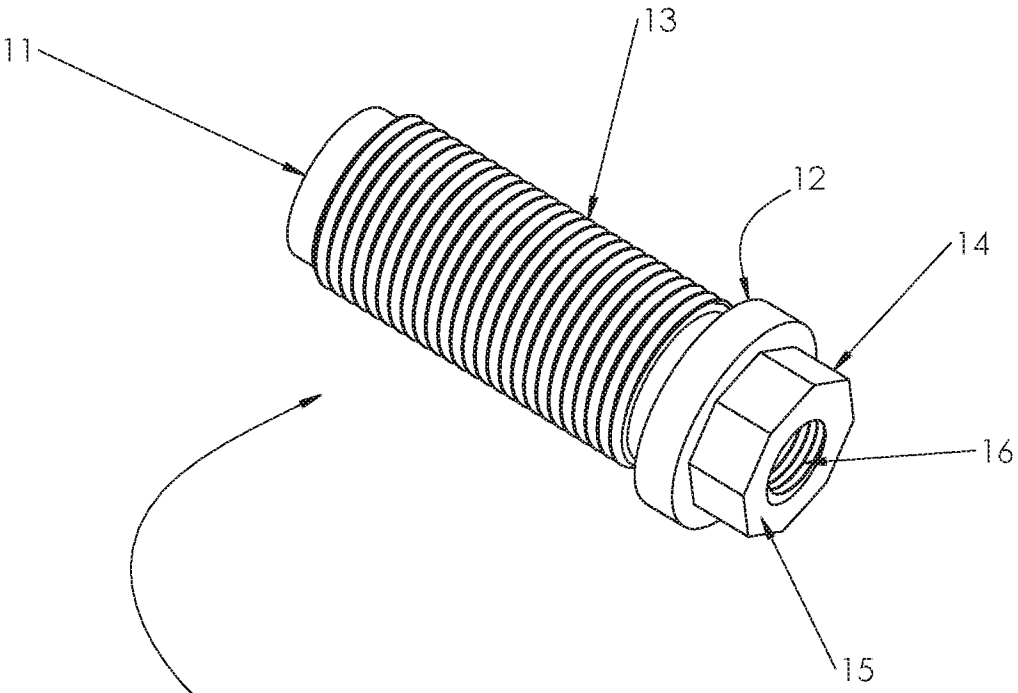
FIG. 2 is a perspective view of a breech plug body of FIG. 1.

Now referring to FIG. 2, there is shown a perspective view of a breech plug body 10 of FIG. 1 which can be made of a heat treated 416 stainless steel or a suitable substitute. Breech plug body 10 includes a breech plug body muzzle end 11 and an opposing breech plug body breech end 15. Breech plug body 10 is hollow with a central axial orifice to provide an ignition path from primer to powder, which includes breech end axial orifice opening 16, breech plug body muzzle end orifice 171 (FIG. 6) and a path therebetween, shown in detail in FIG. 7.

Breech plug body 10, a breech plug body breech end tool engaging portion 14, which can be a hex head or other configuration to facilitate turning with a tool. Sealing shoulder 12 is included to provide a seal to prevent gas and carbon from passing from the barrel around the exterior of the breech plug body 10. Breech plug body externally threaded portion 13 is configured to mate with threads located on the interior portion of a breech end of a muzzleloader rifle. It should be understood that in some embodiments, the sealing shoulder 12 could be replaced with a sealing interface, which could be at the front of the plug instead of the rear.

Figure 3:
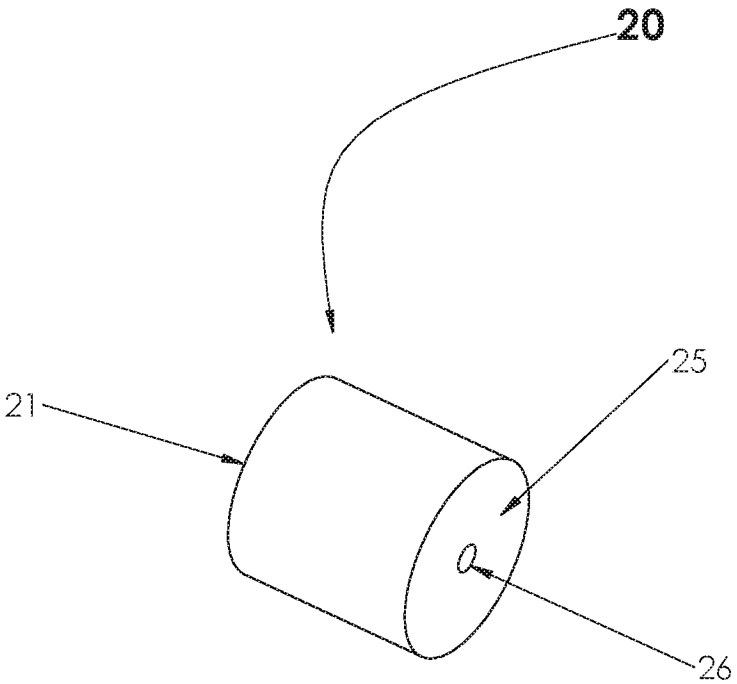
FIG. 3 is a perspective view of a bushing of FIG. 1.

Now referring to FIG. 3, there is shown a bushing 20, with a bushing muzzle end 21, bushing breech end 25 and with a bushing axial orifice 26 extending therethrough. Bushing 20 is removable, replaceable and could be considered a wear part, which could be made of a high temperature/wear resistant material such as tungsten carbide or a suitable substitute. As the hole 26 increases to a point where it will no longer prevent powder from passing through, the bushing 20 can be replaced by removing the retention module 30, removing the worn out bushing and replacing with a new bushing. Bushing 20 is designed to prevent powder from passing completely through the barrel during loading, but, during shooting, still allowing flame from primer to ignite powder while being resistant to gas wear.

Figure 4:
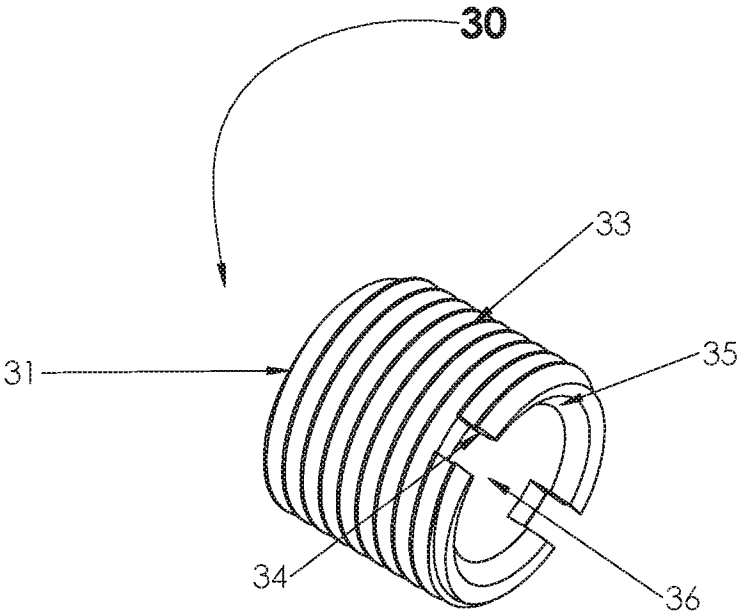
FIG. 4 is a perspective view of bushing retention screw of FIG. 1.

Now referring to FIG. 4, there is shown a retention module 30 designed to thread into the breech plug body internally threaded breech end axial orifice 16 of breech plug body 10 and holds the bushing 20 in place. The retention module axial orifice 36 of the retention module 30 is designed to accept the primer module holder nipple 47 (FIG. 5) of the primer module holder 40. Using retention modules of different lengths, the system could be made to adjust for different firearms with different head-space requirements.

Some alternate embodiments for the retention module are as follows: The retention module could be a press fit without threads to allow for retention of the bushing. The retention module could also be epoxied or soldered or welded into place.

Figure 5:
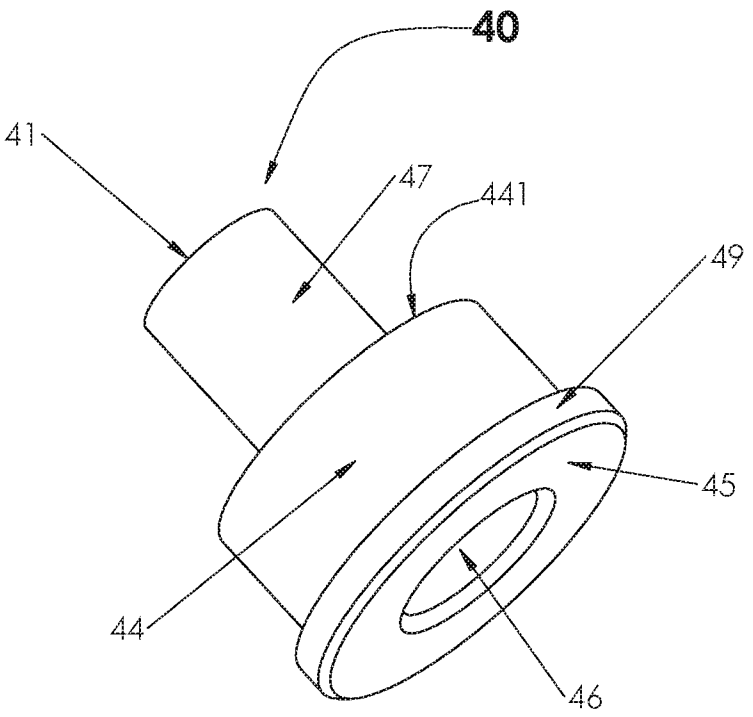
FIG. 5 is a perspective view of a primer module holder of FIG. 1.

Now referring to FIG. 5, there is shown a primer module holder 40, which has a primer module holder muzzle end 41 and a primer module holder breech end 45, and is made of brass or other similar material, and is meant to support the primer and provide easy loading of muzzle loading firearm in the field. The primer module holder nipple 47 on the primer module holder 40 allows consistent sealing between primer module holder 40 and breech plug body 10. The primer module holder 40 has a primer module holder primer receiving orifice 46 designed to accept, by press-fit, a large rifle magnum primer. The primer module holder head body 44, which has a primer module holder head body muzzle end 441, is designed to match the extraction mechanism on various muzzle loading rifles. In the embodiment depicted, the primer module holder nipple 47 has primer module holder nipple end wall 43, decreased in thickness to make the end of primer module holder 40 more pliable and thus create a better seal between primer module holder 40 and retaining insert.

Figure 6:
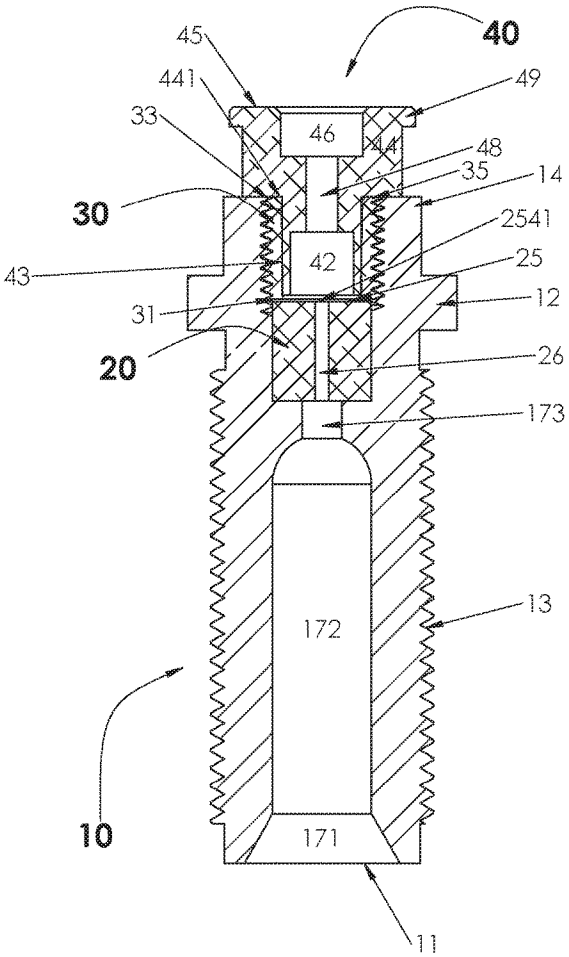
FIG. 6 is a cross-sectional view of the breech primer system of the present invention in an assembled state.

Now referring to FIG. 6, there is shown a cross-sectional view of the components of FIG. 1 in an assembled state. Breech plug body muzzle end orifice 171, breech plug body elongated cylindrical orifice 172, breech plug body non-cylindrical orifice 173 are shown, as well as primer module holder nipple end wall 43, primer module holder nipple carbon collection cavity 42, primer module holder initial ignition orifice 48, and the gap 2541 between bushing breech end 25 and primer module holder muzzle end 41. It one embodiment, this gap is less than 0.05 inches and in another embodiment this gap is less than 0.015 inches. Primer module holder 40 is held in place by the bolt housing the firing pin of the gun. Primer module holder head rim 49 is shown as well.

Figure 7:
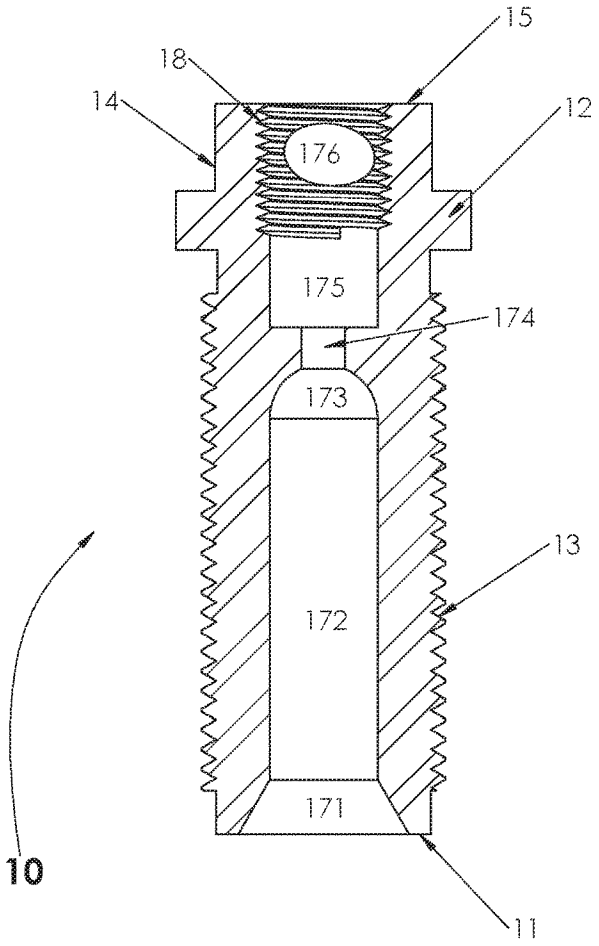
FIG. 7 is a cross-sectional view of the breech plug body of FIGS. 1, 2 and 6.

Now referring to FIG. 7, there is shown a cross-sectional view of the breech plug body 10 of FIGS. 1, 2 and 6. This view shows a clear view of an axial orifice from breech plug body muzzle end 11 to breech plug body breech end 15, which includes the following series of connected orifices, breech plug body muzzle end orifice 171, breech plug body elongated cylindrical orifice 172, breech plug body non-cylindrical orifice 173, breech plug body small diameter cylindrical orifice 174, breech plug body bushing orifice 175, and breech plug body retention module orifice 176, which is bounded in part by breech plug body breech end internally threaded portion 18.

Figure 8:
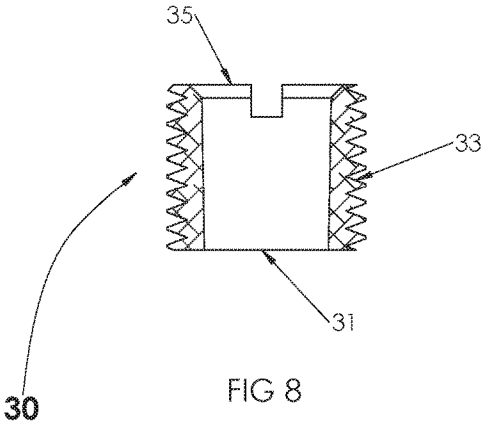
FIG. 8 is a cross-sectional view of the retention module of FIGS. 1, 4 and 6.

Now referring to FIG. 8, there is shown a cross-sectional view of the retention module of FIGS. 1, 4 and 6.

Figure 9:
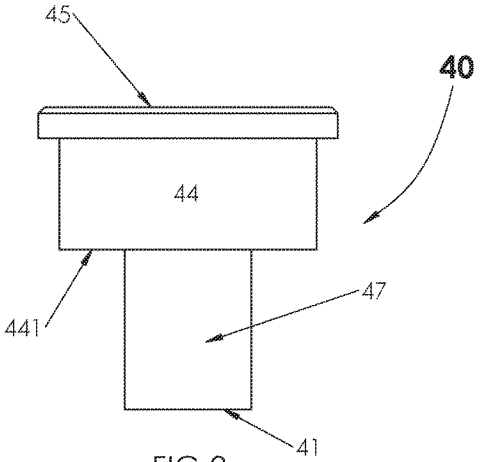
FIG. 9 is a side view of the primer module holder of FIGS. 1, 5 and 6.

Now referring to FIG. 9, there is shown a side view of the primer module holder of FIGS. 1, 5 and 6.

Figure 10:
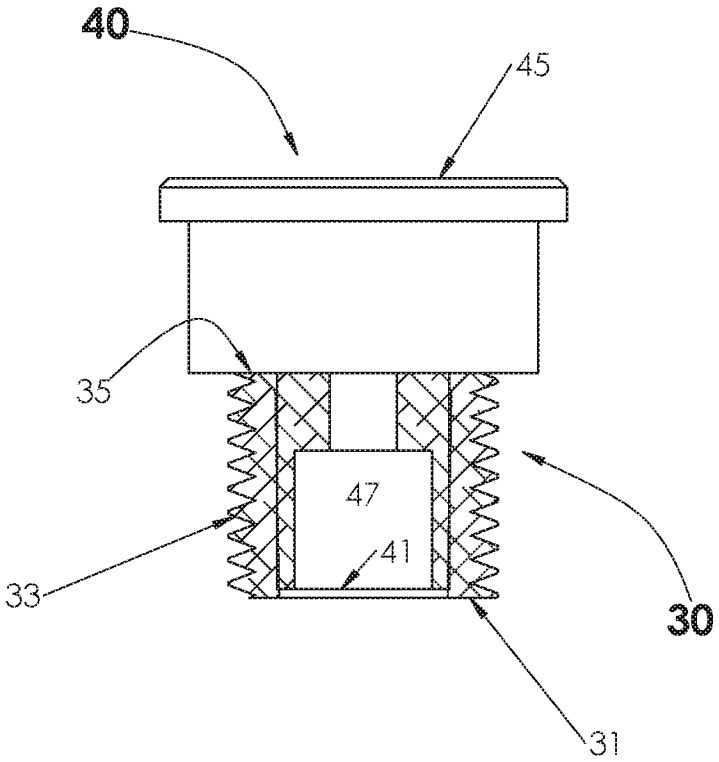
FIG. 10 is a hybrid view of the cross-sectional view of FIG. 8 and the side view of FIG. 9.

Now referring to FIG. 10, there is shown a hybrid view of the cross-sectional view of FIG. 8 and the side view of FIG. 9, which could be envisioned as a side view of a combination of half of the retention module 30, after having been cut as shown in FIG. 8, disposed around the primer module holder nipple 47 of primer module holder 40. It shows the mating of retention module breech end 35 and primer module holder head body muzzle end 441.

Figure 12:
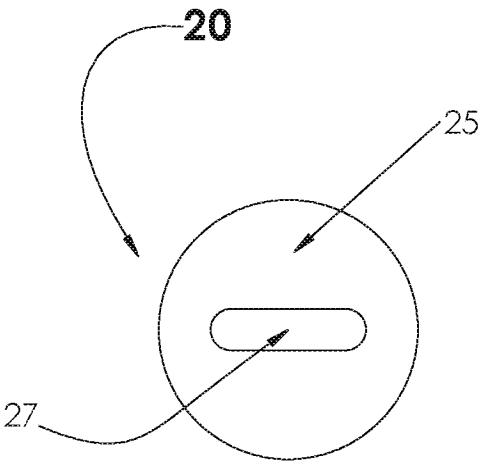
FIG. 12 is an end view of another alternate embodiment of the bushing of FIGS. 1, 3 and 6.
Figure 11:
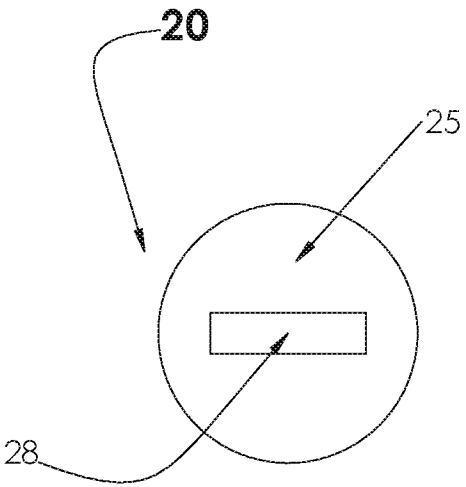
FIG. 11 is an end view of an alternate embodiment of the bushing of FIGS. 1, 3 and 6.

Now referring to FIGS. 11 and 12, there is shown end views of alternate embodiments of the bushing of FIGS. 1, 3 and 6.

FIG. 12 is an end view of another alternate embodiment of the bushing of FIGS. 1, 3 and 6.

In operation, the present invention could be used as follows:

Step 1. Bushing 20 is inserted through the breech plug body breech end axial orifice opening 16, through breech plug body retention module orifice 176 and into breech plug body bushing orifice 175.

Step 2. Bushing 20 is caused to be held in tight engagement with internal structure forming the exterior of breech plug body muzzle end orifice 17 by insertion of retention module 30 into breech plug body internally threaded breech end axial orifice 16 and advancing it by engaging a tool, such as a screw driver, with retention module tool engaging portion 34. This is done until a seal is formed between bushing 20 and the interior portions of breech plug body 10, forming the exterior of breech plug body muzzle end orifice 17. This seal preferably prevents gas and carbon from exiting breech plug body muzzle end orifice 17 around the exterior of bushing 20.

Step. 3. The breech plug body muzzle end 11 of breech plug body 10 is inserted into the breech of mated barrel, and turned by engaging a wrench, to breech plug body breech end tool engaging portion 14. The sealing shoulder 12 is forced to seal to the breech of the barrel by applying sufficient torque to the breech plug body breech end tool engaging portion 14, this prevents gas and carbon from exiting the barrel around the exterior of the breech plug body 10.

Step 4. Now the gun can be loaded with powder and a bullet.

Step 5. Next, a primer is press fit into primer module holder primer receiving orifice 46.

Step 6. In a break action rifle, primer module holder muzzle end 41 is inserted into retention module axial orifice 36, and in a bolt action rifle, primer module holder 40 can be placed in the bolt face of the rifle and subsequently primer module holder muzzle end 41 is inserted into breech plug body 10 through retention module axial orifice 36 by manipulation of the bolt.

Step 7. The bolt of the firearm is closed to contact primer module holder head rim 49, thereby urging primer module holder muzzle end 41 into very close proximity to bushing breech end 25 of bushing 20. The gun is ready for use.

After the gun is fired, the bolt of the gun is opened and the primer module holder 40, with spent primer, is removed. Steps 4-7 of the process are repeated for another shot, if desired.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A system for operatively coupling a firing pin in a gun to powder in a barrel of a muzzleloader rifle, the system comprising:

a breech plug body, having a body muzzle end and opposing body breech end configured to be retained inside a barrel of a muzzleloader rifle;

a bushing, configured to simultaneously restrict powder from exiting through a non-muzzle opening of said barrel while permitting ignition of said powder inside the barrel from an ignition source, said bushing being disposed inside said breech plug body;

a retention member, at least partially disposed inside said breech plug body, and configured to retain said bushing at a location inside said breech plug body;

a primer holder, having a primer holder muzzle end which is configured to be received inside said breech plug body and inside said retention member.

2. The system of claim 1 wherein said breech plug body has a breech plug body externally threaded portion, for mating with the barrel of the muzzleloader rifle and a breech plug body breech end internally threaded portion for mating with said retention member.

3. The system of claim 2 wherein said retention member is hollow and cylindrical with a retention member externally threaded portion.

4. The system of claim 3 wherein said retention member is configured to be advanced through the breech plug body breech end internally threaded portion when said retention member is rotated.

5. The system of claim 4 wherein said primer holder is a primer module holder with a primer module holder muzzle end and a primer module holder breech end, where said primer module holder muzzle end is sized and configured to translate through said retention member.

6. The system of claim 5 wherein said bushing has a bushing axial orifice therethrough; and said breech plug body and said retention member are configured to permit removal of said bushing from said breech plug body while said breech plug body is retained inside the barrel of the muzzleloader rifle.

7. The system of claim 6 wherein said bushing axial orifice has an elongated opening.

8. The system of claim 7 wherein said elongated opening is oval shaped.

9. The system of claim 7 wherein said elongated opening is rectangular shaped.

10. The system of claim 6 wherein a separation distance between said bushing and said primer holder is less than 0.05 inches.

11. The system of claim 10 wherein the separation distance between said bushing and said primer holder is less than 0.015 inches.

12. The system of claim 1 wherein said retention member is configured to engage an internal portion of said breech plug body and be advanced into the breech plug body by applying a force to said retention member.

13. The system of claim 12 wherein said retention member is configured to be press fit, without threads, into the breech plug body.

14. The system of claim 12 wherein said retention member is retained in said breech plug body with one of a solder joint, a weld, and epoxy.

15. The system of claim 1 wherein said retention member is retained in said breech plug body with one of a solder joint, a weld, and epoxy.

16. A system for igniting powder in a barrel of a muzzleloader rifle, the system comprising:

a breech member, having a first end and opposing second end configured to be retained inside a barrel of a muzzleloader rifle;

a first member, configured to restrict powder from exiting through a non- muzzle opening of said barrel while permitting ignition of said powder inside the barrel from an ignition source, said first member being disposed inside said breech member;

a second member, at least partially disposed inside said breech member, and configured to retain said first member at a location inside said breech member; and a primer holder, and a primer holder muzzle end which is configured to be received inside said breech member and inside said second member.

17. The system of claim 16 wherein said breech member which has a breech member external portion, configured for cooperation with the barrel of the muzzleloader rifle and a breech member breech end internal portion configured for cooperation with said second member.

18. The system of claim 17 wherein said second member is hollow with a second member externally threaded portion.

19. The system of claim 18 wherein said second member is configured to be advanced through the breech member breech end internal portion when said second member is rotated.

20. A system for igniting powder in a rifle, the system comprising:

a breech member, having a first end and opposing second end configured to be retained inside a barrel of a rifle;

a first member, configured to restrict powder from exiting through a non- muzzle opening of said barrel while permitting ignition of said powder inside the barrel, said first member being disposed inside said breech member;

a second member, at least partially disposed inside said breech member, and configured to retain said first member at a location inside said breech member; and a primer holder, and a primer holder muzzle end which is configured to be received inside said breech member and inside said second member.

* * * * *